US005117208A

United States Patent [19]

Nar

[11] Patent Number: 5,117,208

[45] Date of Patent: May 26, 1992

[54] MULTIPOLE CIRCUIT BREAKER

[75] Inventor: Ramesh G. Nar, Cambridge, Md.

[73] Assignee: North American Philips Corporation, New York, N.Y.

[21] Appl. No.: 526,851

[22] Filed: May 21, 1990

[51] Int. Cl.[5] ..... H01H 75/00

[52] U.S. Cl. ..... 335/8; 335/172

[58] Field of Search ..... 335/8-10, 335/167-172, 6

[56] References Cited

U.S. PATENT DOCUMENTS 3,290,627 4/1965 Davis et al. ..... 335/172
3,646,487 2/1972 Bracketter ..... 335/8
4,347,488 8/1982 Mune et al. ..... 335/9

FOREIGN PATENT DOCUMENTS 202344 4/1939 Switzerland .

*Primary Examiner*—Leo P. Picard
*Assistant Examiner*—Lincoln Donovan
*Attorney, Agent, or Firm*—Robert T. Mayer

[57] ABSTRACT

A new single pole circuit breaker, intended for use in a multipole circuit breaker, is disclosed. Among other distinctions, upon being tripped, a relatively large torque is imparted to the trip lever of the single pole circuit breaker. This is achieved by interacting the contact bar stop pin on the contact bar of the single pole circuit breaker with a camming surface on the trip lever. In addition, when pivotal motion is imparted to the trip lever by an external agent, the trip lever directly engages the toggle mechanism of the circuit breaker, to collapse the toggle mechanism and produce tripping. Moreover, the trip lever has a configuration which permits convenient pivotal mounting to a frame.

9 Claims, 10 Drawing Sheets

MULTIPOLE CIRCUIT BREAKER

BACKGROUND OF THE INVENTION

1. Field Of The Invention

The present invention pertains generally to circuit breakers and, more particularly, to multipole circuit breakers.

2. Description Of The Related Art

A single pole circuit breaker is a device which serves to interrupt electrical current flow in an electrical circuit path upon the occurrence of an overcurrent in the circuit path. On the other hand, a multipole circuit breaker is a device which includes two or more interconnected, single pole circuit breakers which serve to substantially simultaneously interrupt current flow in two or more circuit paths upon the occurrence of an overcurrent in any one circuit path.

An example of a single pole circuit breaker of the type used in conventional multipole circuit breakers is depicted in FIG. 1. As shown, the single pole circuit breaker 10 includes an electrically insulating casing 20 which houses, among other things, stationarily mounted terminals 30 and 40. In use, these terminals are electrically connected to the ends of the electrical circuit which is to be protected against overcurrents.

As is known, the casing 20 also houses a stationary electrical contact 50 mounted on the terminal 40 and an electrical contact 60 mounted on a contact bar 70. Significantly, the contact bar 70 is pivotably connected via a pivot pin 80 to a stationarily mounted frame 100. A helical spring 85, which encircles the pivot pin 80, pivotally biases the contact bar 70 toward the frame 100. A contact bar stop pin 90, mounted on the contact bar 70, limits the pivotal motion of the contact bar relative to the frame. By virtue of the pivotal motion of the contact bar 70, the contact 60 is readily moved into and out of electrical contact with the stationary contact 50.

An electrical coil 110, which encircles a magnetic core 120 topped by a pole piece 130, is positioned adjacent the frame 100. An electrical braid 140 serves to electrically connect the terminal 30 to one end of the coil 110. An electrical braid 150 connects the opposite end of the coil 110 to the contact bar 70. Thus, when the contact bar 70 is pivoted in the clockwise direction (as viewed in FIG. 1), against the biasing force exerted by the spring 85, to bring the contact 60 into electrical contact with the contact 50, a continuous electrical path extends between the terminals 30 and 40.

As is conventional, the circuit breaker 10 also includes a handle 160 which is pivotably connected to the frame 100 via a pin 170. In addition, a toggle mechanism is provided, which connects the handle 160 to the contact bar 70. This toggle mechanism includes a cam link 190 which is pivotably connected to the handle 160 via a pin 180. The toggle mechanism also includes a link housing 200, which itself includes a projecting arm 205, the link housing being pivotably connected to the cam link 190 by a rivet 210 and pivotably connected to the contact bar 70 by a pin 220. The toggle mechanism further includes a sear assembly, including a sear pin 230 which extends through the link housing to the cam link 190. The sear assembly also includes a leg 235, connected to the sear pin 230, and a sear striker bar 240, which is connected to the leg 235 and projects into the plane of the paper, as viewed in FIG. 1. A helical spring 250, which encircles the sear pin 230, biases the leg 235 of the sear assembly into contact with the leg 205 of the link housing, thereby biasing a planar surface on the sear pin 230 into engagement with a step on the cam link 190. It is by virtue of this engagement that the toggle mechanism is locked and thus capable of opposing and counteracting the pivotal biasing force exerted by the spring 85 on the contact bar 70, thereby maintaining the electrical connection between the contacts 50 and 60.

By manually pivoting the handle 160 in the counterclockwise direction (as viewed in FIG. 1), the toggle mechanism, while remaining locked, is translated and rotated out of alignment with the pivotal biasing force exerted by the spring 85 on the contact bar 70. This biasing force then pivots the contact bar 70 in the counterclockwise direction, toward the frame 70, resulting in the electrical connection between the contacts 50 and 60 being broken. Manually pivoting the handle 160 in the clockwise direction then serves to reverse the process.

The single pole circuit breaker 10 also includes an armature 260, pivotably connected to the frame 100. This armature includes a leg which is positioned adjacent the sear striker bar 240. In the event of an overcurrent in the circuit to be protected, this overcurrent will necessarily also flow through the coil 110, producing a magnetic force which induces the armature to pivot toward the pole piece 130. As a consequence, the armature leg will strike the sear striker bar 240, collapsing the toggle mechanism. In the absence of the opposing force exerted by the toggle mechanism, the biasing force exerted by the spring 85 on the contact bar 70 will pivot the contact bar in the counterclockwise direction, toward the frame 70, resulting in the electrical connection between the contacts 50 and 60 being broken.

Significantly, the single pole circuit breaker 10 also includes a trip lever 270 which is pivotably connected to the frame 100 via a pivot pin 320. As more clearly depicted in FIG. 2, the trip lever 270 is generally U-shaped and includes arms 280 and 290 which at least partially enfold the frame 100. A helical spring 330, positioned between the frame 100 and arm 280 and encircling the pin 320, pivotally biases the trip lever toward the frame 100. A projection 300 of the trip lever 270 is intended for insertion into an aperture 310 of the trip lever of an adjacent single pole circuit breaker. Thus, any pivotal motion imparted to the trip lever 270, in opposition to the biasing force exerted by the spring 330, is transmitted to the adjacent trip lever, and vice versa.

If, for example, an overcurrent flows through the coil 110 of the single pole circuit breaker 10, then, as a result, as described above, the single pole circuit breaker 10 will be tripped, i.e., the contact bar 70 will be pivoted in the counterclockwise direction and the electrical connection between the contacts 50 and 60 will be broken. During this pivoting motion, the pin 220, pivotably connecting the link housing 200 to the contact bar 70, will engage a camming surface 285 on the bottom of the leg 280, thereby applying a torque to the trip lever 270. Consequently, the trip lever 270 will be pivoted away from the frame 100 and toward the armature 260. This pivotal motion will also be imparted to the trip lever of the adjacent single pole circuit breaker via the projection 300. Provided the torque applied by the pin 220 is sufficiently large, then the trip lever of the adjacent single pole circuit breaker will depress the corresponding armature, thereby tripping the adjacent circuit breaker.

While single pole circuit breakers of the type described above are certainly useful, they do have certain limitations. For example, when such a single pole circuit breaker is tripped, the torque exerted by the pin 220 on the trip lever 270 is necessarily limited. As noted, this torque is transmitted by the trip lever 270 to the trip lever of the adjacent single pole circuit breaker, which must then depress the corresponding armature before the corresponding toggle mechanism is engaged and collapsed. Thus, a significant fraction of the developed torque is dissipated in depressing the armature. As a consequence, the number of interconnected, single pole circuit breakers which can be substantially simultaneously tripped is limited, i.e., the number is typically no more than six. In addition, the reliability with which six such interconnected, single pole circuit breakers are tripped is sometimes less than one hundred percent.

Not only does the conventional single pole circuit breaker have the limitations discussed above, but the process of mounting the conventional trip lever 270 onto the frame 100 is relatively difficult and time consuming, and sometimes causes difficulties. That is, during the mounting process, the holes in the legs 280 and 290 of the trip lever 270 (see FIG. 2) are aligned with the corresponding holes in the frame 100, and the pin 320 is then inserted through the aligned holes. The leg 280 is then deformed until it snaps over the pin 320, to permit the spring 330 to be mounted onto the pin 320. While the leg 280 is then bent back toward its original position, the result may be such that the initial deformation is not entirely eliminated or, in some cases, deformation is also imparted to the adjacent leg 290. As a consequence, in operation, the leg 280 alone, or both legs 280 and 290, may, for example, rub against the inner walls of the casing 20, preventing the single pole circuit breaker from tripping at the desired trip point. Alternatively, if the deformation of the leg 280 is not substantially eliminated, then, during operation, the pin 220 may not properly engage the camming surface 285 on the leg 280.

Thus, those engaged in developing multipole circuit breakers have sought, thus far unsuccessfully, a single pole circuit breaker in which, upon being tripped, a relatively large torque is applied to the trip lever, a circuit breaker mechanism which avoids torque dissipation, and a trip lever which is conveniently mounted onto the corresponding frame.

SUMMARY OF THE INVENTION

The invention involves a single pole circuit breaker, intended for use in a multipole circuit breaker, in which, upon being tripped, a significantly larger torque is applied to the trip lever of the circuit breaker than was previously possible. This relatively large torque is achieved because it is delivered via the contact bar stop pin on the contact bar of the circuit breaker, and applied to a camming surface on the trip lever of the circuit breaker engageable by the stop pin.

The inventive single pole circuit breaker also includes a sear assembly having two sear striker bars, one of which is directly engageable by the trip lever of the circuit breaker. Significantly, in the event that an adjacent single pole circuit breaker is tripped, the resulting torque delivered to the inventive single pole circuit breaker is used to pivot the trip lever of the inventive circuit breaker directly into contact with one of the sear striker bars, thereby collapsing the toggle mechanism of the inventive circuit breaker.

The trip lever of the inventive single pole circuit breaker is generally similar to previous trip levers in that it is generally U-shaped and includes two arms. However, by contrast with previous trip levers, one of the arms of the inventive trip lever includes an open-ended slot in place of the usual hole, which enables the inventive trip lever and its biasing spring to be readily mounted onto a frame without the need for bending the arm.

By virtue of the above features, significantly more than six, e.g., eighteen, of the inventive single pole circuit breakers, when interconnected, are readily substantially simultaneously tripped. In addition, the reliability with which, for example, six interconnected, inventive single pole circuit breakers are tripped is essentially one hundred percent. Moreover, the process of assembling the inventive single pole circuit breaker is relatively easy and inexpensive.

BRIEF DESCRIPTION OF THE DRAWINGS

The invention is described with reference to the accompanying drawings, wherein.

DETAILED DESCRIPTION OF THE PREFERRED EMBODIMENTS

The invention involves a new single pole circuit breaker, intended for use in a multipole circuit breaker, in which, upon being tripped, a significantly larger torque is applied to the trip lever of the single pole circuit breaker than was previously achievable. In addition, in the event an adjacent single pole circuit breaker is tripped, the torque delivered to the inventive single pole circuit breaker is used to pivot the trip lever of the circuit breaker directly into contact with the toggle mechanism of the circuit breaker, thereby tripping the toggle mechanism while avoiding torque dissipation. Moreover, the trip lever of the inventive single pole circuit breaker has a configuration which makes it relatively easy to mount the trip lever and the trip lever biasing spring to a frame.

Figure 1:
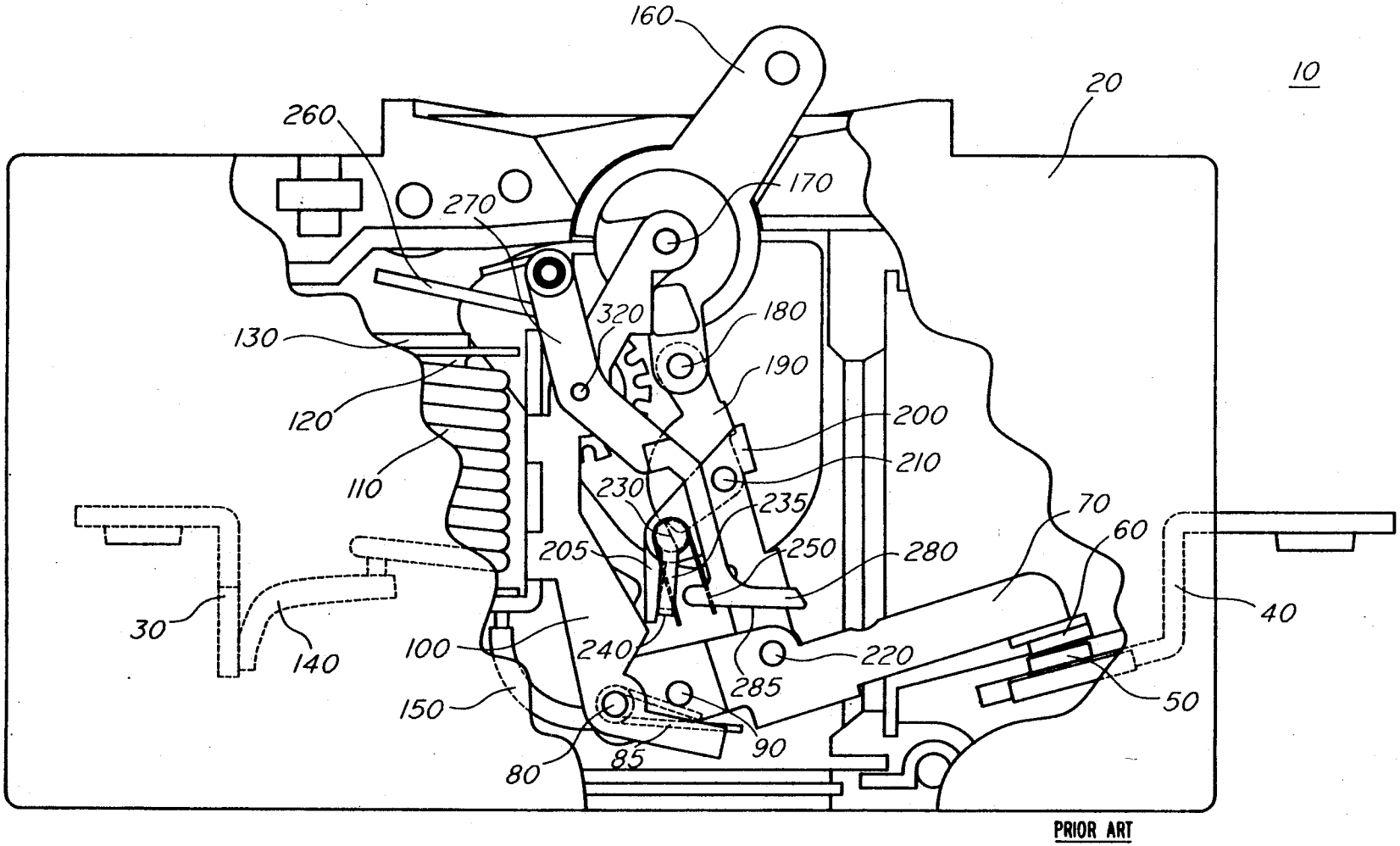
FIG. 1 is a view of the mechanism of a conventional single pole circuit breaker, intended for use in a multipole circuit breaker.
Figure 2:
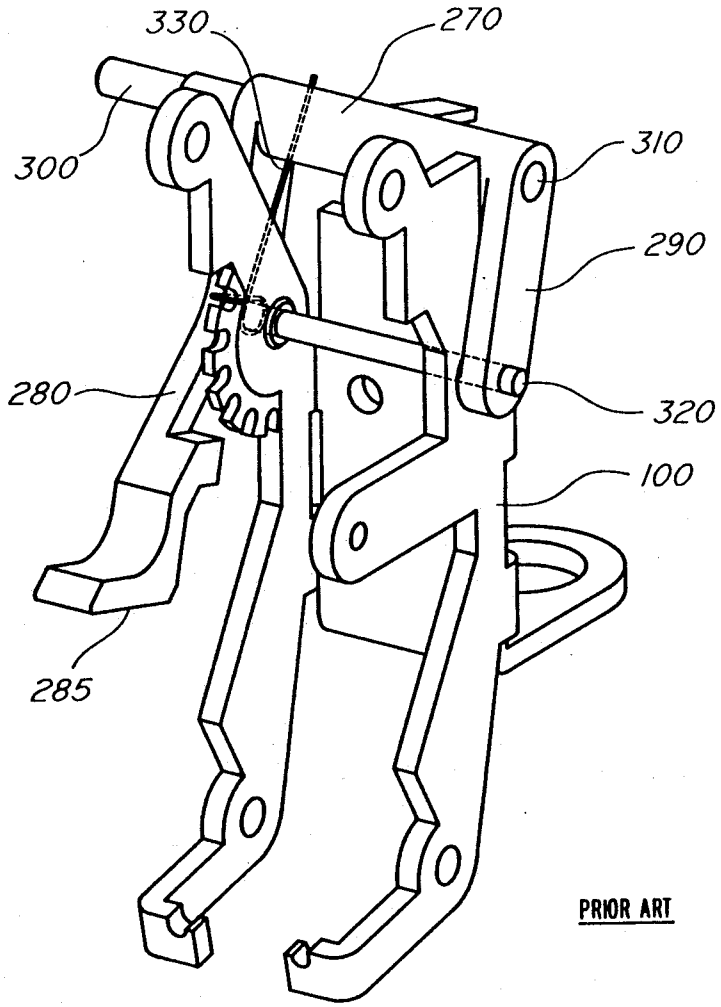
FIG. 2 is a perspective view of the trip lever, frame and trip lever biasing spring employed in the conventional single pole circuit breaker depicted in FIG. 1.
Figure 3:
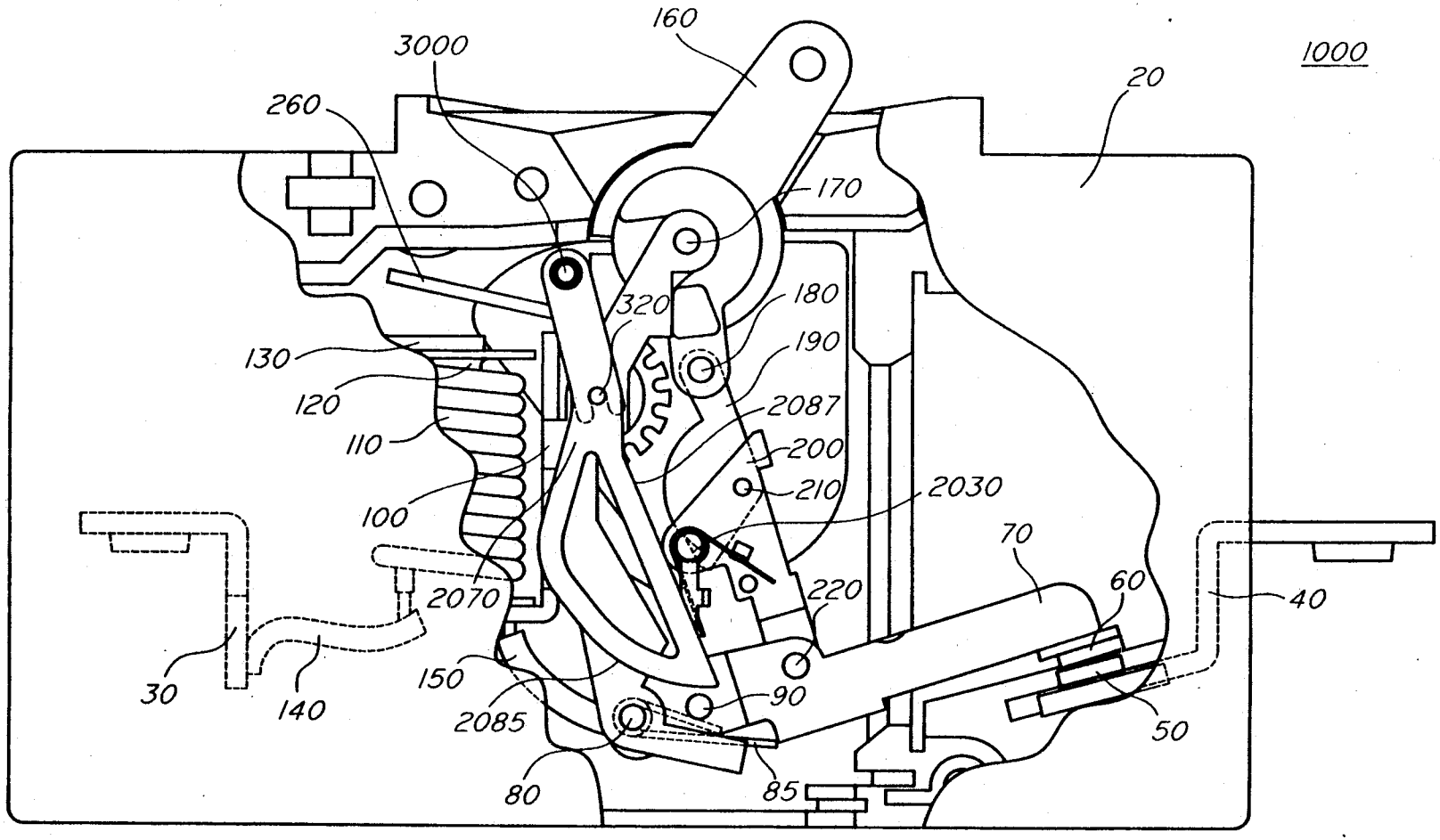
FIG. 3 is a view of the mechanism of the inventive single pole circuit breaker in the contacts-closed position.
Figure 4:
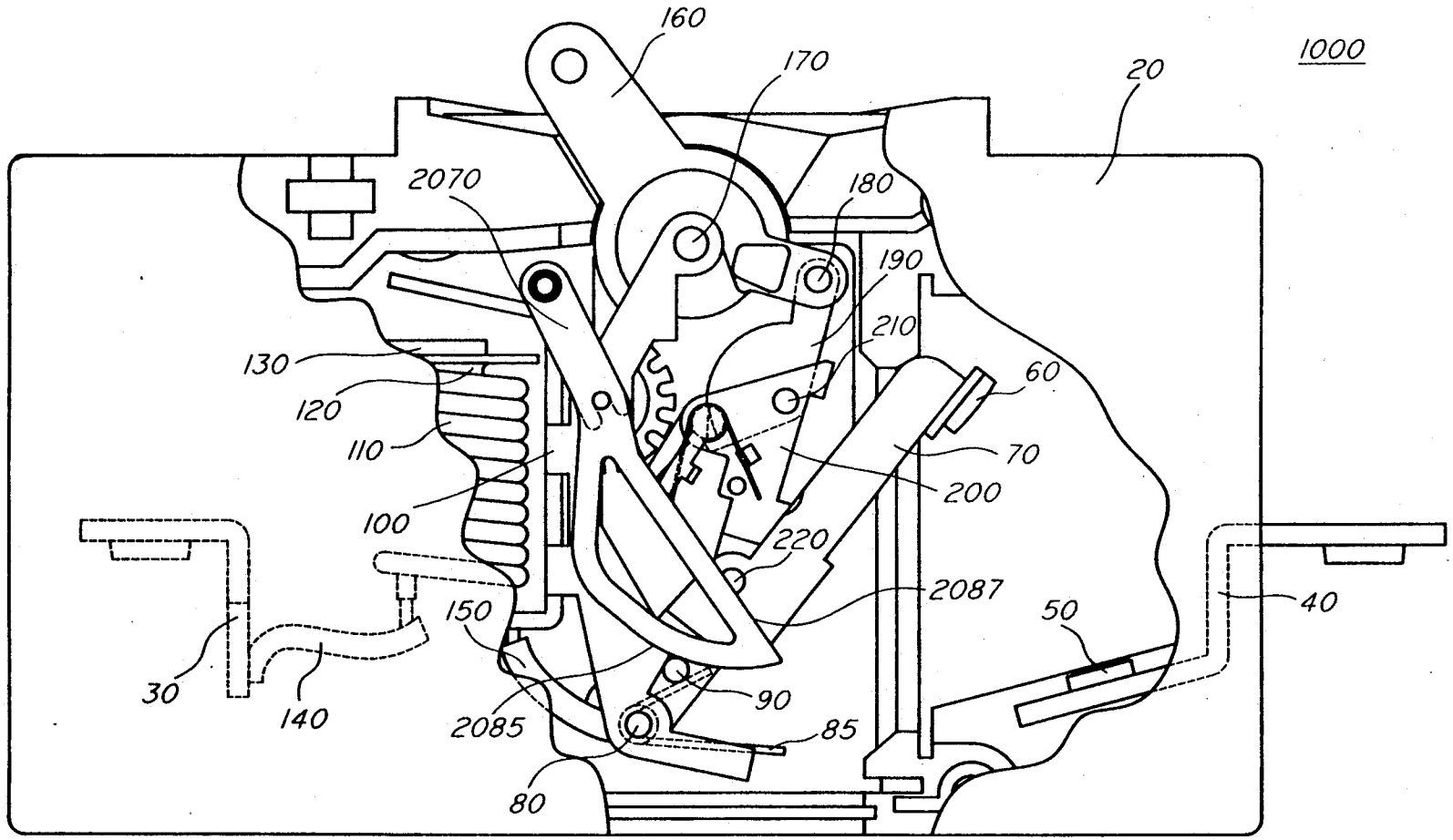
FIG. 4 is a view of the mechanism of the inventive single pole circuit breaker in the contacts-open position.

With reference to FIGS. 3 and 4, the inventive single pole circuit breaker 1000 is generally similar to the conventional single pole circuit breaker 10 depicted in FIG. 1, with like parts being denoted by like numerals. However, there are a number of important differences between the two, these differences being highlighted through the introduction of new numerals. For example, one of the differences involves the use of a new trip lever 2070, which is pivotably connected to the frame 100 by the pivot pin 320. As shown, the trip lever 2070 includes a camming surface 2085 which, in the event the circuit breaker 1000 is tripped, as depicted in FIG. 4, is engaged by the stop pin 90 (rather than the pin 220, as in the conventional single pole circuit breaker 10) on the contact bar 70. This change in circuit breaker configuration arose from the recognition that the magnitude of the torque imparted to a trip lever is determined, in part, by the magnitude of the corresponding force. Moreover, the source of this force is the helical spring 85, encircling the pivot pin 80, which pivotally biases the contact bar 70 toward the frame 100. Because the force exerted by the spring 85 decreases nonlinearly with distance from the spring, a relatively large force, and therefore a relatively large torque, is only achievable through proximity to the spring 85. Thus, in accordance with the invention, advantage is taken of the proximity of the stop pin 90 to the spring 85, the stop pin 90 here serving both to deliver the torque to the trip lever 2070 and to limit the pivotal motion of the contact bar 70.

The above discussion should not be interpreted to imply that the position of the stop pin 90 on the contact bar 70 in the single pole circuit breaker 1000 is necessarily identical to that in the conventional single pole circuit breaker 10. Rather, the position of the stop pin 90 on the contact bar 70 and the shape of the camming surface 2085 are chosen to achieve substantially continuous contact between the stop pin and the camming surface and substantially continuous rotation of the trip lever 2070 when the contact bar 70 is pivoted in the counterclockwise direction by the biasing spring 85. In this regard, in the absence of contact between the stop pin 90 and the camming surface 2085, the stop pin 90 undergoes continuous counterclockwise rotation under the influence of the biasing force exerted by the spring 85. This is then translated into substantially continuous counterclockwise rotation of the trip lever 2070 by using a camming surface 2085 which is essentially free of concavities, i.e., is essentially convex or essentially flat (planar), and is positioned in the path of the stop pin 90.

Figure 5:
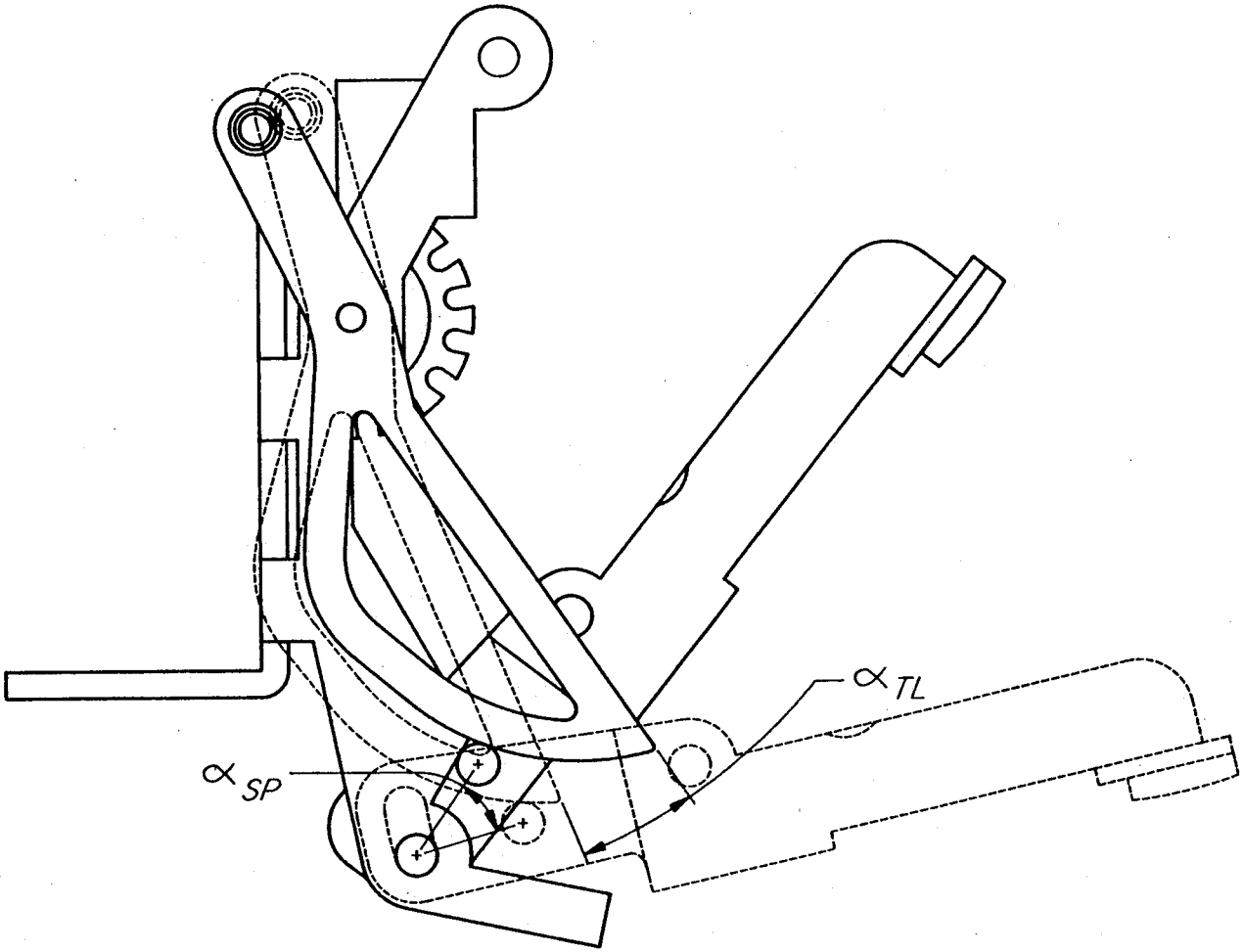
FIG. 5 depicts the angular displacement of the stop pin and the angular displacement of the trip lever during the operation of the inventive single pole circuit breaker.

The position of the stop pin 90 and the shape of the camming surface 2085 should also be chosen so that, in operation, the ratio of the total angular displacement of the stop pin 90, $\alpha_{SP}$ (see FIG. 5), to the total angular displacement of the trip lever 2070, $\alpha_{TL}$, i.e., $\alpha_{SP}/\alpha_{TL}$, ranges from about 1.0 to about 8.0, and preferably ranges from about 1.5 to about 4.0. Ratios smaller than about 1.0 are undesirable because the corresponding angular displacement of the trip lever 2070 is likely to be so large that the trip lever becomes jammed. On the other hand, ratios larger than about 8.0 are undesirable because the corresponding angular displacement of the trip lever 2070 is likely to be so small that the corresponding pivotal motion imparted to an adjacent trip lever will be insufficient to enable the adjacent trip lever to effectively engage the corresponding sear striker bar, as discussed below.

Figure 6:
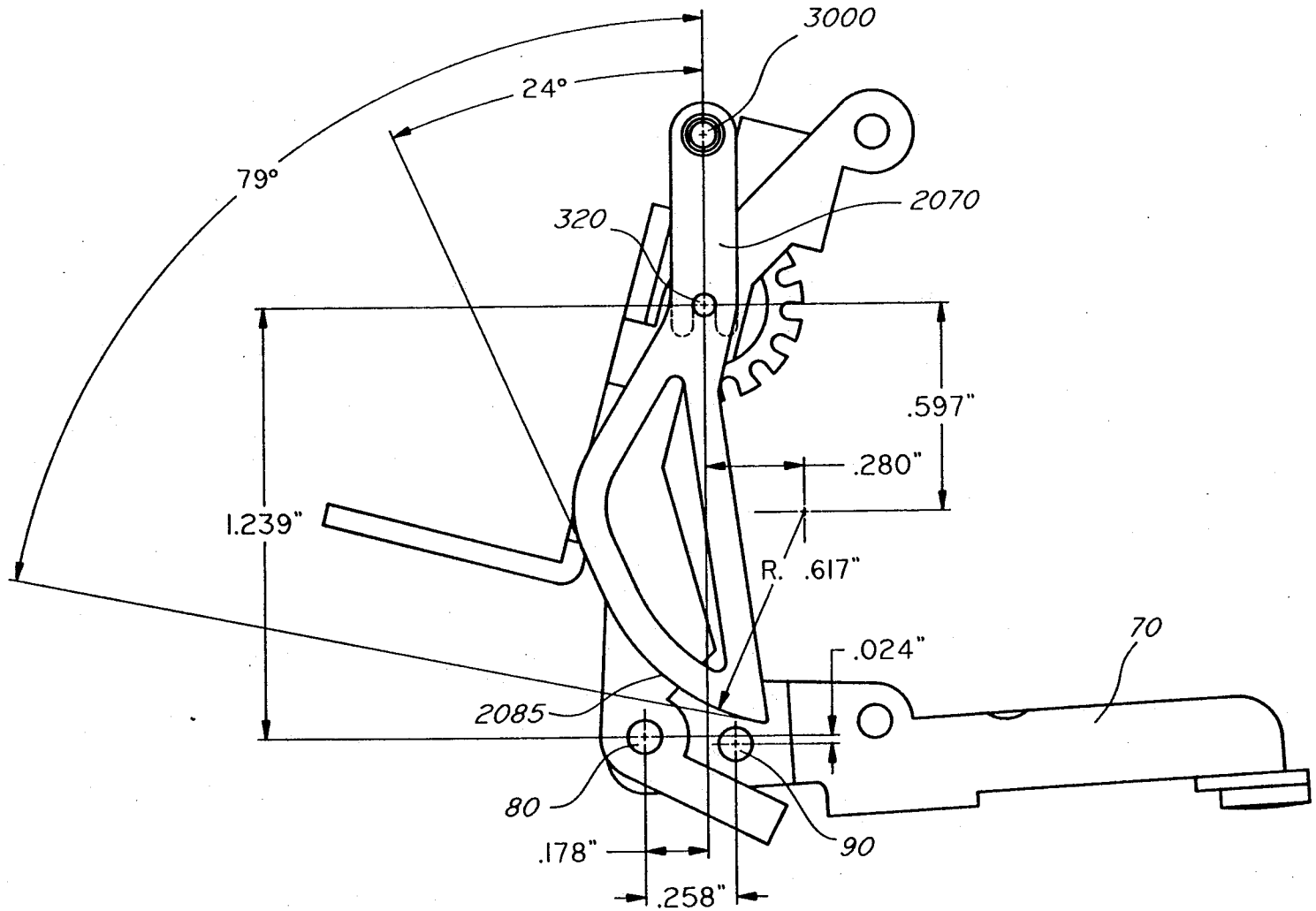
FIG. 6 depicts the dimensions of certain features of a preferred configuration of the inventive single pole circuit breaker.

Uselful positions of the stop pin 90 and useful corresponding shapes of the camming surface 2085 which conform to all the above requirements are readily determined empirically by varying the position of the stop pin 90 and/or the shape of the camming surface 2085. A preferred configuration which meets these requirements is depicted in FIG. 6. As shown, the trip lever 2070 and the contact bar 70 have been oriented so that in the contacts-closed position of the circuit breaker 1000, a line extending from the projection 3000 (discussed below) to the pivot pin 320 is vertically oriented, and serves as a reference line. In this preferred configuration, the camming surface 2085 constitutes an arc of a circle, the corresponding radius of which is R=0.617 inches (15.7 millimeters). The center of this circle is located at a point which is 0.280 inches (7.11 millimeters) to the right (as viewed in FIG. 6) of, and 0.597 inches (15.2 millimeters) below, the pivot pin 320. A tangent drawn to the point at which the circular arc begins forms an angle of 79° with the reference line. A tangent drawn to the point at which the circular arc ends forms an angle of 24° with the reference line. (Beyond the circular arc, there is a straight, flat surface which is not a part of the camming surface 2085.)

In the preferred configuration, the pivot pin 80 is located 1.239 inches (31.5 millimeters) below, and 0.178 inches (4.52 millimeters) to the left of, the pin 320. In addition, the stop pin 90 is located 0.258 inches (6.55 millimeters) to the right of, and 0.024 inches (0.61 millimeters) below, the pivot pin 80.

Figure 7:
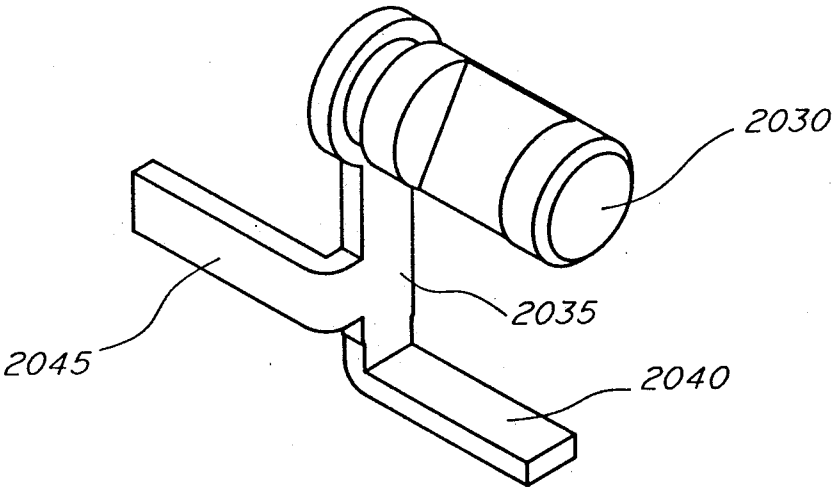
FIG. 7 is a perspective view of the cam link and sear assembly employed in the inventive single pole circuit breaker.
Figure 7:
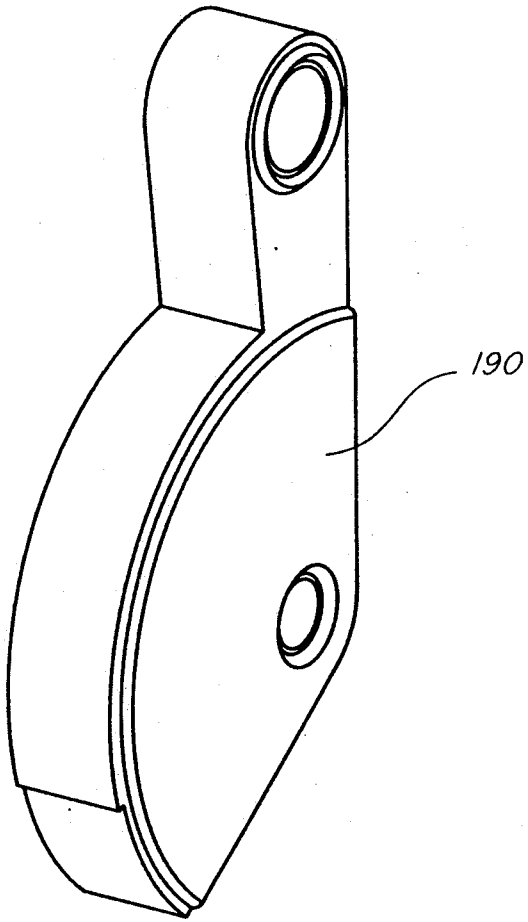

Another difference between the single pole circuit breaker 1000 and the conventional single pole circuit breaker 10 is the nature of the sear assembly employed in the former. That is, as more clearly depicted in FIG. 7, the new sear assembly includes a sear pin 2030, which (as is conventional includes a planar surface used to engage a corresponding step in the cam link 190. In addition, the sear assembly includes a leg 2035, to which is attached a first sear striker bar 2040 normally engaged by the leg of the armature 260 upon the occurrence of an overcurrent in the circuit breaker 1000. Significantly, the new sear assembly also includes a second sear striker bar 2045 attached to the arm 2035. This second sear striker bar 2045 is positioned so that in the event an adjacent single pole circuit breaker suffers an overcurrent and, as a result, imparts a counterclockwise pivotal motion to the trip lever 2070, the front surface 2087 (see FIG. 3) of the trip lever 2070 will strike the sear striker bar 2045, collapsing the toggle mechanism of the circuit breaker 1000. Thus, the occurrence of an overcurrent in an adjacent single pole circuit breaker produces tripping of the single pole circuit breaker 1000 without the need to depress the armature 260, which otherwise dissipates torque.

Figure 8:
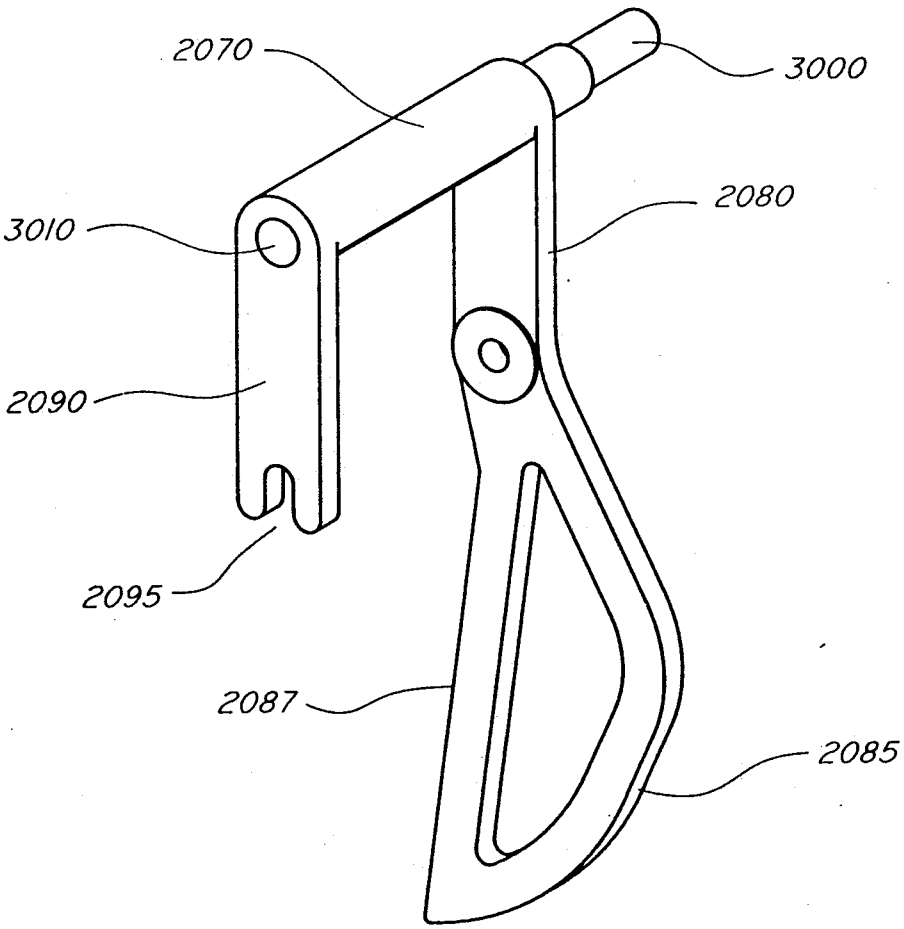
FIG. 8 is a perspective view of the trip lever employed in the inventive single pole circuit breaker.
Figure 9:
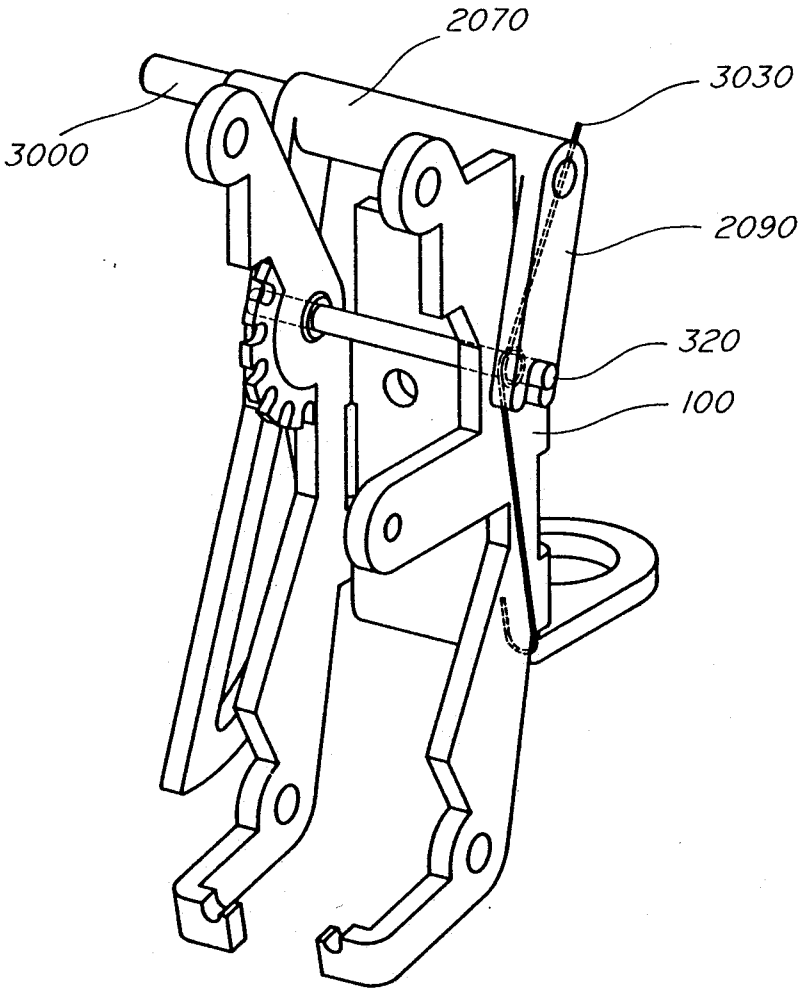
FIG. 9 is a perspective view of the trip lever, frame and trip lever biasing spring employed in the inventive single pole circuit breaker.

The inventive single pole circuit breaker 1000 is also distinguished by the relative ease with which the trip lever 2070 and its biasing spring 3030 (see FIG. 9) are mounted to the frame 100. That is, as depicted in FIGS. 8 and 9, the trip lever 2070 is generally U-shaped and includes arms 2080 and 2090 which are intended to at least partially enfold the frame 100. Significantly, the arm 2090 includes an open-ended slot 2095 in place of the usual hole. When mounting the trip lever 2070, the pin 320 (see FIG. 9) is first inserted into the holes in the legs of the frame 100. Then, the biasing spring 3030 is mounted on the pin 320, outside the frame 100, adjacent the position to be occupied by the leg 2090 of the trip lever 2070. The pin 320 is now pushed through the holes of the frame until it is flush with the hole distant from the spring 3030 and protrudes from the hole adjacent the spring 3030. The trip lever 2070 is now mounted on the frame 100 so that the slot 2095 in the leg 2090 engages the protruding pin 320 and the hole in the leg 2080 is aligned with the pin 320. The pin 320 is then pushed into the hole in the leg 2080, completing the mounting procedure. Clearly, there is no bending of either leg 2080 or leg 2090, which avoids the problems encountered in mounting conventional trip levers.

Figure 10:
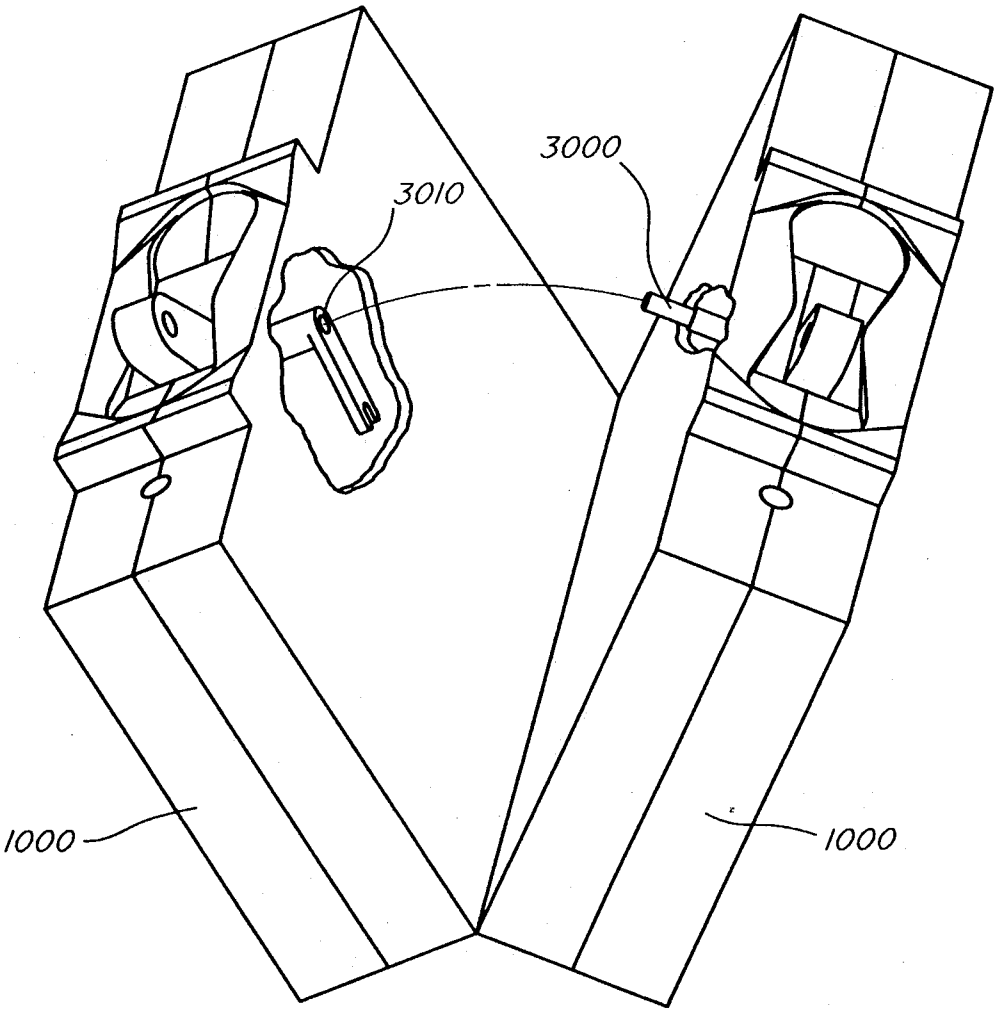
FIG. 10 depicts how two, inventive single pole circuit breakers are interconnected to form a multipole circuit breaker.

As depicted in FIG. 8, the trip lever 2070 includes a longitudinal aperture 3010 intended for receiving the projection 3000 of the trip lever of an adjacent single pole circuit breaker. It is by virtue of such projections and longitudinal apertures that two or more single pole circuit breakers 1000 are readily interconnected to form a multipole circuit breaker, as depicted in FIG. 10.

What is claimed is:

1. A multipole circuit breaker including at least first and second single pole circuit breaker mechanisms, at least said first mechanism comprising:

a frame;

a first electrical contact which is substantially stationary relative to said frame;

a contact bar, bearing a second electrical contact, which is pivotably connected to said frame via a pivot pin, said contact bar including a contact bar stop pin which is operable to limit the pivotal motion of said contact bar;

means for pivoting said contact bar, in response to an overcurrent through the circuit breaker mechanism, from a first position, where said electrical contacts are electrically connected, to a second position, where said electrical contacts are electrically disconnected; and a trip lever which is pivotably connected to said frame, said trip lever including a first convex surface, capable of acting as a camming surface, which is engageable by said contact bar stop pin, the position of the contact bar stop pin on the contact bar and the shape of said first convex surface being chosen to achieve substantially continuous contact between the contact bar stop pin and the first convex surface to produce substantially continuous rotation of the trip lever when the contact bar is pivoted from said first to said second position.

2. The multipole circuit breaker of claim 1, wherein the position of said contact bar stop pin on the contact bar and the shape of said camming surface are also chosen so that the ratio of the angular displacement of said contact bar stop pin to the angular displacement of said trip lever, corresponding to the pivotal movement of said contact bar from said first position to said second position, ranges from about 1.0 to about 8.0.

3. The multipole circuit breaker of claim 2, wherein said ratio ranges from about 1.5 to about 4.0.

4. The multipole circuit breaker of claim 1, wherein said means includes a toggle mechanism, said toggle mechanism including a member which, when moved, causes the toggle mechanism to collapse and, as a result, enables said contact bar to pivot from said first to said second position.

5. The multipole circuit breaker of claim 4, wherein said means further includes a spring which encircles said pivot pin and biases said contact bar to pivot from said first toward said second position, said spring serving to pivot said contact bar from said first to said second position upon collapse of said toggle mechanism.

6. The multipole circuit breaker of claim 4, wherein said trip lever includes a second surface and said member is positioned so that upon pivotal movement of said trip lever, said second surface moves said member and collapses said toggle mechanism.

7. The multipole circuit breaker of claim 1, wherein said second single pole circuit breaker mechanism also includes an associated frame and said associated trip lever pivotably connected to said associated frame, and wherein the trip levers of said first and second mechanisms are connected to each other, whereby pivotal motion imparted to one of the levers is transmitted to the other lever.

8. A multipole circuit breaker including at least first and second single pole circuit breaker mechanisms, each of said mechanisms comprising:

a frame;

a first electrical contact which is substantially stationary relative to said frame;

a contact bar, bearing a second electrical contact, which is pivotable connected to said frame via a pivot pin, said contact bar including a contact bar stop pin which is operable to limit the pivotal motion of said contact bar;

means for pivoting said contact bar, in response to an overcurrent through the circuit breaker mechanism, from a first position, where said electrical contacts are electrically connected, to a second position, where said electrical contacts are electrically disconnected; and a trip lever which is pivotable connected to said frame, said trip lever including a first convex surface, capable of acting as a camming surface, which is engageable by said contact bar stop pin, the position of the contact bar stop pin on the contact bar and the shape of said first convex surface being chosen to achieve substantially continuous contact between the contact bar stop pin and the first convex surface to produce substantially continuous rotation of the trip lever when the contact bar is pivoted from said first to said second position.

9. The multipole circuit breaker of claim 1, wherein said second single pole circuit breaker mechanism also includes a frame and trip lever pivotably connected to the frame, and wherein the trip levers of said first and second mechanisms are connected to each other, whereby pivotal motion imparted to one of the levers is transmitted to the other lever.

* * * * *